US011608648B2

(12) United States Patent
Wigfield

(10) Patent No.: US 11,608,648 B2
(45) Date of Patent: Mar. 21, 2023

(54) SYSTEM OF DRYWALL FINISHING IN BUILDING CONSTRUCTION

(71) Applicant: Level 6 Technologies, LLC, Lago Vista, TX (US)

(72) Inventor: Jeffrey S. Wigfield, Lago Vista, TX (US)

(73) Assignee: LEVEL 6 TECHNOLOGIES, LLC, Lago Vista, TX (US)

( * ) Notice: Subject to any disclaimer, the term of this patent is extended or adjusted under 35 U.S.C. 154(b) by 154 days.

(21) Appl. No.: 16/416,143

(22) Filed: May 17, 2019

(65) Prior Publication Data

US 2021/0148123 A1 May 20, 2021

Related U.S. Application Data

(60) Provisional application No. 62/672,667, filed on May 17, 2018.

(51) Int. Cl.
*E04F 21/165* (2006.01)

(52) U.S. Cl.
CPC ..... *E04F 21/1652* (2013.01); *E04F 21/1657* (2013.01)

(58) Field of Classification Search
CPC . E04F 21/165; E04F 21/1652; E04F 21/1657; A47L 13/11; A47L 13/12
See application file for complete search history.

(56) References Cited

U.S. PATENT DOCUMENTS

| | | | | |
|---|---|---|---|---|
| 5,143,264 | A | 9/1992 | MacMillan | |
| 6,688,367 | B1 | 2/2004 | Ruposky et al. | |
| 6,874,965 | B1 | 4/2005 | Mondloch et al. | |
| 7,217,053 | B2 * | 5/2007 | Alexander | A47L 13/11 401/139 |
| 7,806,613 | B2 | 10/2010 | Mondloch et al. | |
| 9,889,464 | B1 | 2/2018 | Winne | |
| 10,870,996 | B2 * | 12/2020 | Telleria | B24B 55/06 |

* cited by examiner

*Primary Examiner* — Jennifer C Chiang
(74) *Attorney, Agent, or Firm* — Innovation Capital Law Group, LLP; Vic Lin

(57) ABSTRACT

A system for finishing an interior or exterior drywall surface of a building structure by applying a formulation of dispensable compound material in liquified form at continuous flow with simultaneous surface finishing characteristics while reducing labor intensity and maximizing finish quality to a level 5 standard.

15 Claims, 6 Drawing Sheets

SYSTEM OF DRYWALL FINISHING IN BUILDING CONSTRUCTION

CROSS REFERENCE TO RELATED APPLICATION

This application claims the benefit of U.S. Provisional Application, Ser. No. 62/672,667 filed May 17, 2018.

FIELD OF THE INVENTION

The present invention relates, generally to the field of building construction in connection with a high efficiency method and apparatus of delivering and distributing a source of liquefied compound and applying said compound on a target drywall surface and uniformly finishing in a singular operation in a superior means. More specifically the present invention relates to a system of hand tool used in application and finishing treatment of drywall surfaces to a level 5 quality typically demanded for highest quality interior wall construction.

BACKGROUND OF THE INVENTION

In the scope of interior wall construction in connection with building facilities, including but not limited to industrial, commercial or residential construction, various forms of materials also known as drywall, gypsum board, plasterboard, cement board, greenboard, blueboard, wood sheets or foam board are utilized in forming interior surfacing, and in some cases exterior building wall and/or ceiling systems, also generally referred to as interior wallboard construction. Again, various types of applicators or delivery systems, wipe down tools, knives and scrapers are used to create a flat finished wall of various levels of finishes from rough to fine finish.

One step method involves flat finishing boxes that apply compounds, mastics, coatings have been in use for years as articulated in U.S. Pat. No. 5,143,264 MacMillan. A laborer fills the head which can be attached to a handle and deliver compound onto an unfinished wall. Another step methods is to use a roller and knife combination as in U.S. Pat. No. 6,688,367 Ruposky. U.S. Pat. No. 6,874,965 Mondloch, is an improvement, where a tool is used to apply and smooth, but not to a level 5 finish and the compound to be applied is stored in the handle cylinder and must be frequently refilled. U.S. Pat. No. 7,806,613 Mondloch, is an improvement over prior art but is a delivery system only. Finally other approaches like U.S. Pat. No. 9,889,464 Winne, involve a water and sponge tool to eliminate sanding. Neither of these systems combine the multiple steps to create a level 5 finish in a single operation.

Such construction, while generally of flat surfaces in walls and ceilings, may also be curved wall or ceiling by design where materials may be rolled to various curvatures and non-conventional artistic treatments. Traditional plaster walls require a very labor intensive fabrication process utilizing teams of skilled laborers for separate steps of application of surface compound, scraping excess compound and finishing the surface pursuant to the required final interior surface. In so doing, the operation depends upon speed, efficiency and cost effective methods, especially today, in terms of competitive bidding of construction disciplines. This tool allows a single person to accomplish the work of at least three laborers.

Individual pre-formed panels or equivalent rolled materials are positioned and fastened side by side and top to bottom as continuous surfaces, which embody walls or ceilings, and are mounted and joined together into single building systems. Tape is generally applied over gaps, seams or joints through the use of taping tools prior to applying and smoothing the surface coating.

Tape and mastic or equivalent are used in combination to seal, fill and conceal any gaps and secure the individual panels or equivalent material, with the an objective result being to function and appear as a single seamless simple surface in individual building systems.

In order to complete this objective and create uniform surface quality and building system appearance and function, industrially referred as "level 5" standard, it is necessary to apply a liquefied compound material, at large, to the overall building system surface over said tape and mastic, in order to provide for a high quality of finish and uniformity of surface to minimize joint or fastener "photographing"/appearing through final decoration.

This all involves multiple steps of individual activities and intermediate wait periods and is very time consuming and tedious. The process described herein is extremely labor intensive, involves waste of surface compound and is not ergonomically compatible with physical exertion and strain of an operator. Many in the drywall labor force over several years develop physical impairments associated with musculoskeletal effects related to the drywall construction industry. Surface sanding creates hazardous airborne contaminants that are hazardous to labor.

SUMMARY OF THE INVENTION AND ADVANTAGES

The subject invention comprises a method and apparatus in a complete operation, that streamlines the currently employed and the scope of work of labor allocation and intensiveness, efficiency of liquefied compound application and surface finishing to desired properties and appearance.

A preferred embodiment of the apparatus is significantly reduced apparatus weight and ergonomics, for expediency in workmanship. In application by operation, the apparatus reduces compound waste as it utilizes consistently direct application at pre-determined distances from the output source to target surface thereby eliminating excess residual compound and waste. The tool is easy to manufacturer thereby reducing expendable tool costs from project to project.

In combination with the compound delivery to the target surface the apparatus works in combination with a finishing tool simultaneous to the velocity and viscosity of the liquefied compound. There is no flat finishing box or storage cannon as utilized in existing continuous flow drywall tools and no finish squeegee.

The apparatus has the capability of performing and completing the same project scope of work at a factor of 3.5 (three and a half times) more efficiency than existing methods of construction and implementation.

Compound is driven from a source hopper tank through a hand held directed applicator consisting of an extension handle and distribution head that outputs formulation suitable for high speed drywall treatment in the form of variable characteristic droplets at predetermined velocity and viscosity in a fan shaped pattern from a spraying distribution head located on the tool handle with the finishing head, allowing one laborer to fulfill an operation normally comprising of a team of at least three laborers in individual steps.

As an integral object of operation of the application apparatus consists of:

(a) the distance to the target surface is variable via attachable-detachable pre-sized roller wheels that glide consistently along the target surface and are available in a variety of diameters to adjust to the desired surface quality (b) the width and spread of the coverage to target surface, is variable via adjustable arms that predetermine the placement and width of compound material distribution density and coverage (c) interchangeable smoothing blade widths from 6" to 36" integrate to the adjustable arms in correlation with the desired surface quality and target coverage in (b). Prior to this tool one had to manually apply the joint compound from a bucket to the wallboard, then go back with a separate tool and wipe the joint compound excess down to achieve a rough finish and then go through a further process of sanding and further smoothing. This resulted in a lot of wasted material as well as many wasted man hours.

This tool, by attaching it to an airless pumping system applies the joint compound to the wallboard by spraying and smoothing the joint compound in one step. This will require only one man to perform what used to take at least 3 men to do. The tool allows you to control the fan of the joint compound with a conventional spray gun. The tool keeps the spray fan of the joint compound the exact distance from the wallboard surface that is needed in order to achieve a perfect finish. With the attached squeegee the tool will perfectly smooth the joint compound onto the wallboard joints, which will in turn achieve a perfect finish in one step with less material waste and less man hours.

There will be 3 different size tools to apply the $1^{st}$, $2^{nd}$ and $3^{rd}$ coats of joint compound that is required to finish wallboard. This tool will allow work to be performed from the floor on 10'-12' walls and ceilings without the need for scaffolding, stilts or ladders. One man can perform the work on both tops and bottoms of the wallboard.

With a 50 foot hose attached to the airless pumping system it will minimize the trips needed going back and forth to the bucket that holds the joint compound in order to fill up your handheld tools. The tool also applies compound ("mud") directly to the wallboard surface thereby not dropping joint compound on the floor and wasting it. You and your work area will remain much cleaner than it would have using the conventional methods.

You will be able to put a larger surface area of joint compound on the wallboard joint that will be flatter and smoother than conventional methods. The typical 12" joint will become a 22" joint using less material resulting in a smoother finish.

Once mastered, the tool will make applying joint compound much faster than it has ever been applied using conventional methods. The tool will make applying the sought after, flawless Level 5 finish much more achievable. It provides for consolidating a multiple of steps into one operation, making Level 5 applications of drywall material more efficient and utilizing less man power and materials. Overall you can achieve a smoother more perfect finish that will require much less sanding, waste and man hours than conventional application methods.

While the present invention has been described in terms of particular embodiments and applications, in both summarized and detailed forms, it is not intended that these descriptions in any way limit its scope to any such embodiments and applications, and it will be understood that many substitutions, changes and variations in the described embodiments, applications and details of the method and system illustrated herein and of their operation can be made by those skilled in the art without departing from the spirit of this invention.

Figure 1:
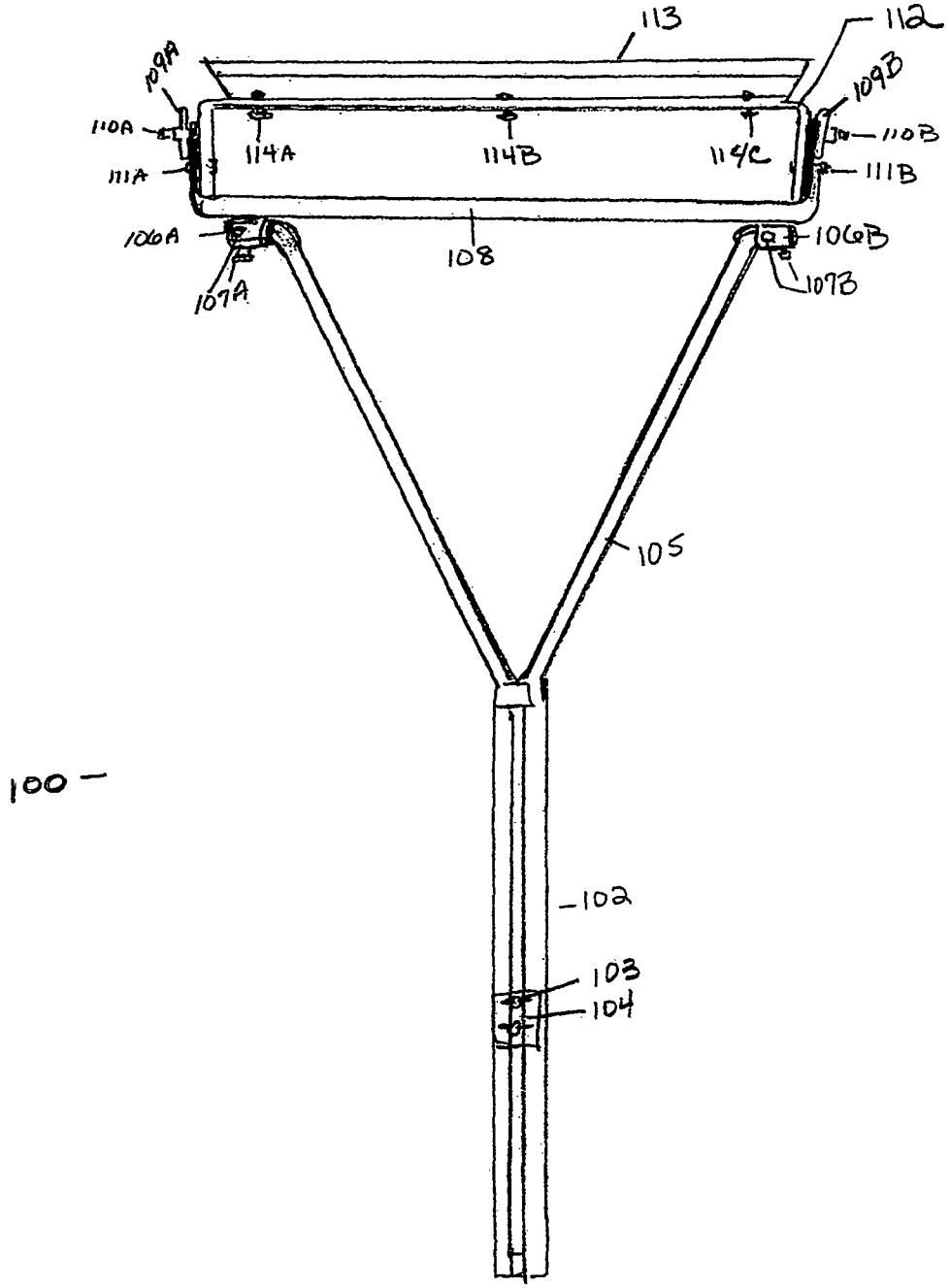
FIG. 1
Figure 2:
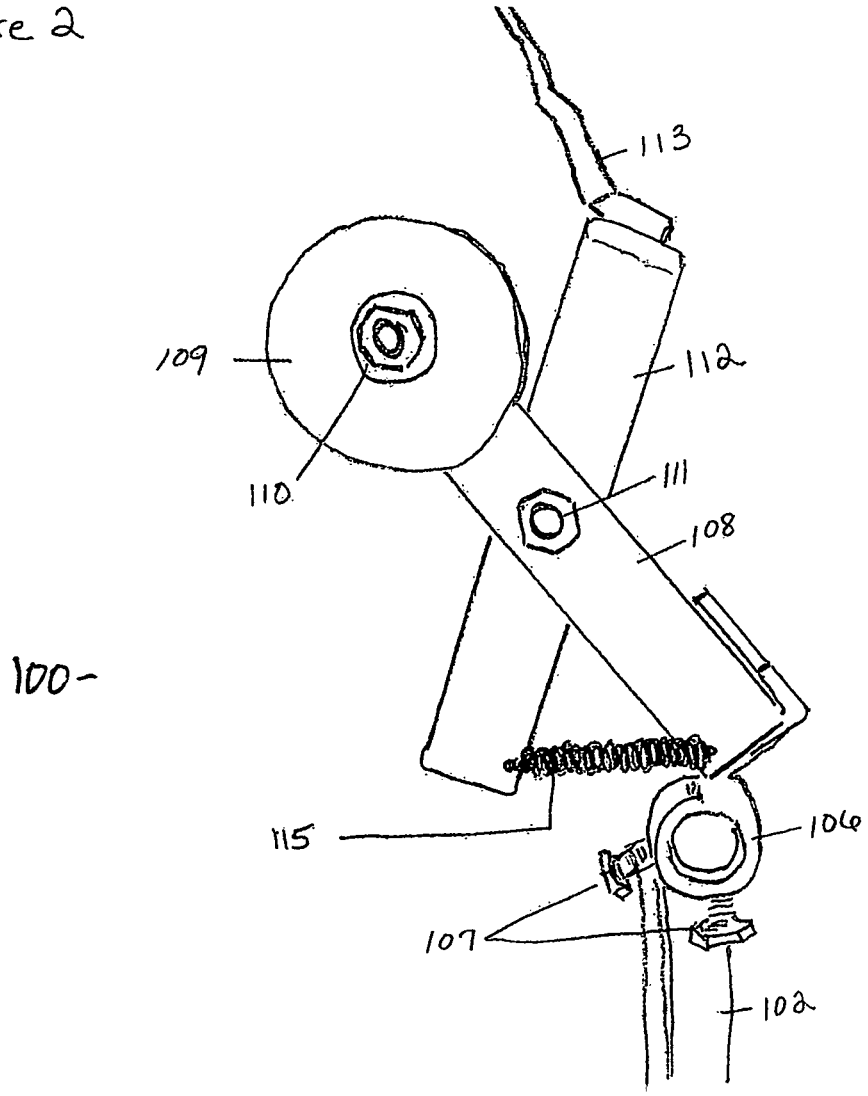
Figure 3:
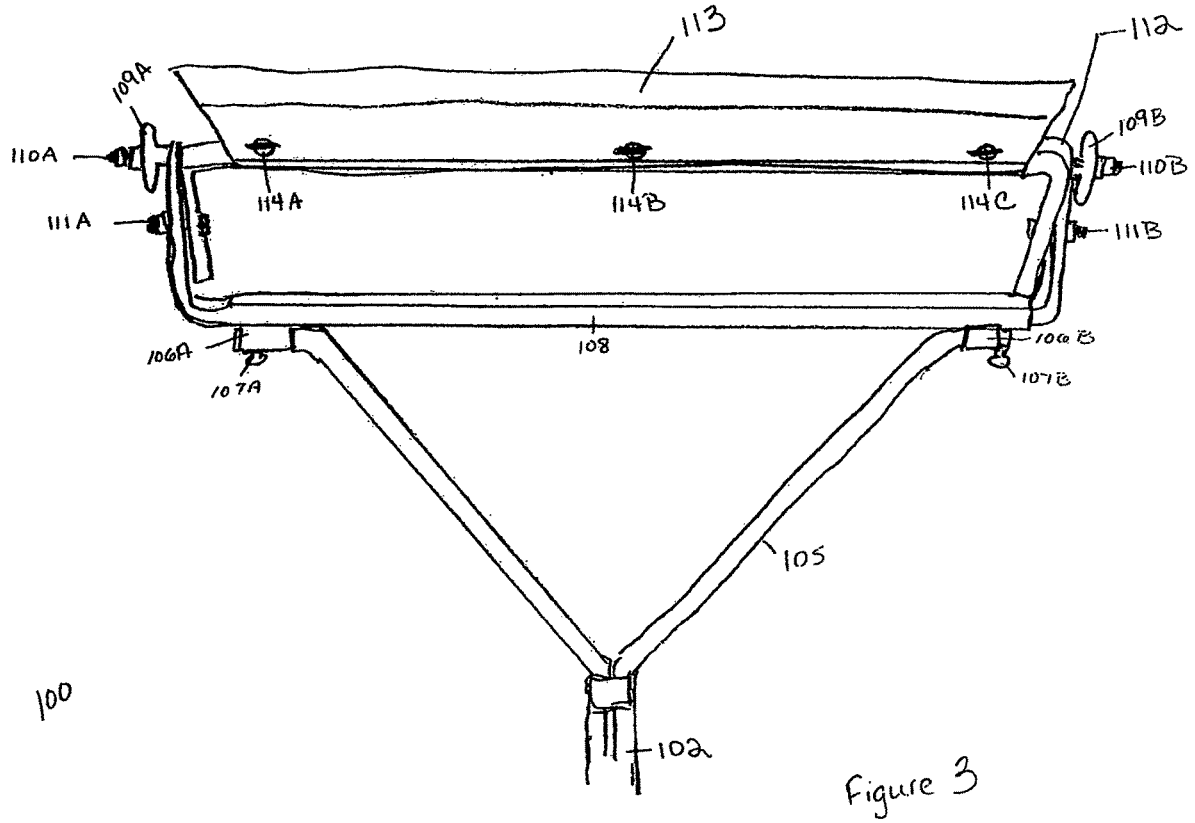
Figure 4:
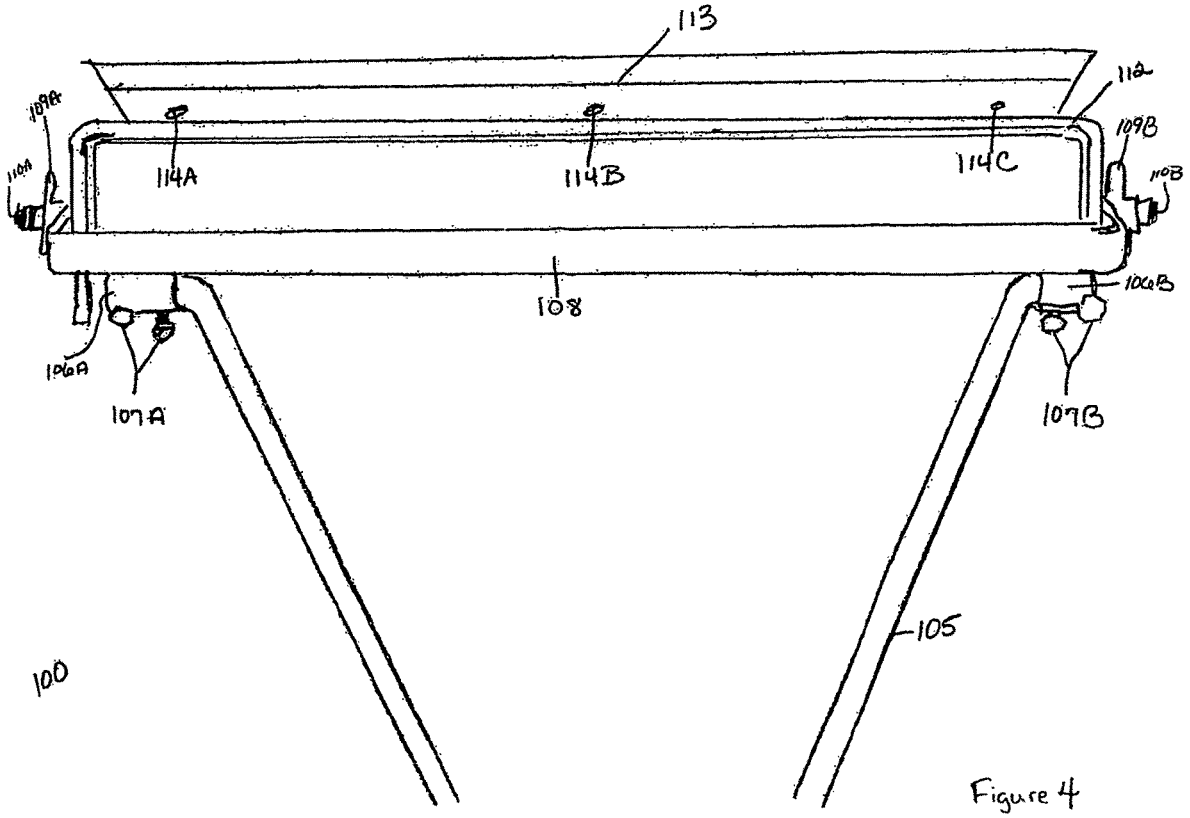
Figure 5:
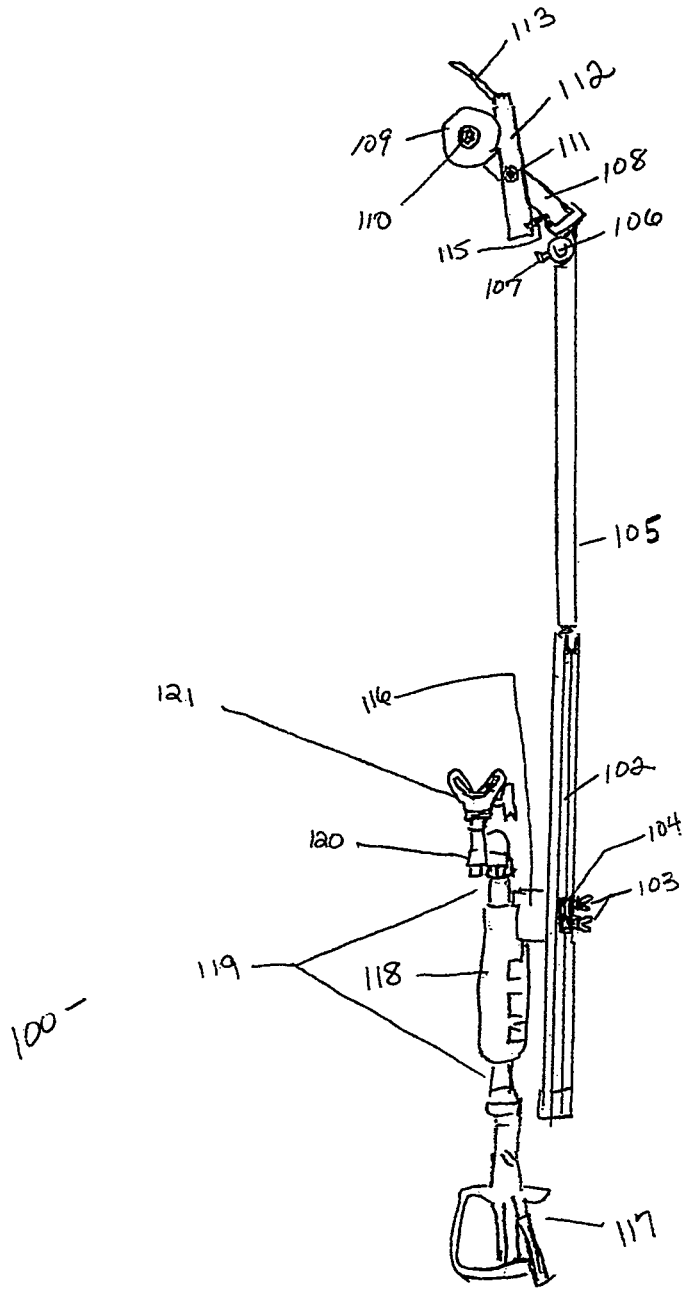
Figure 6:
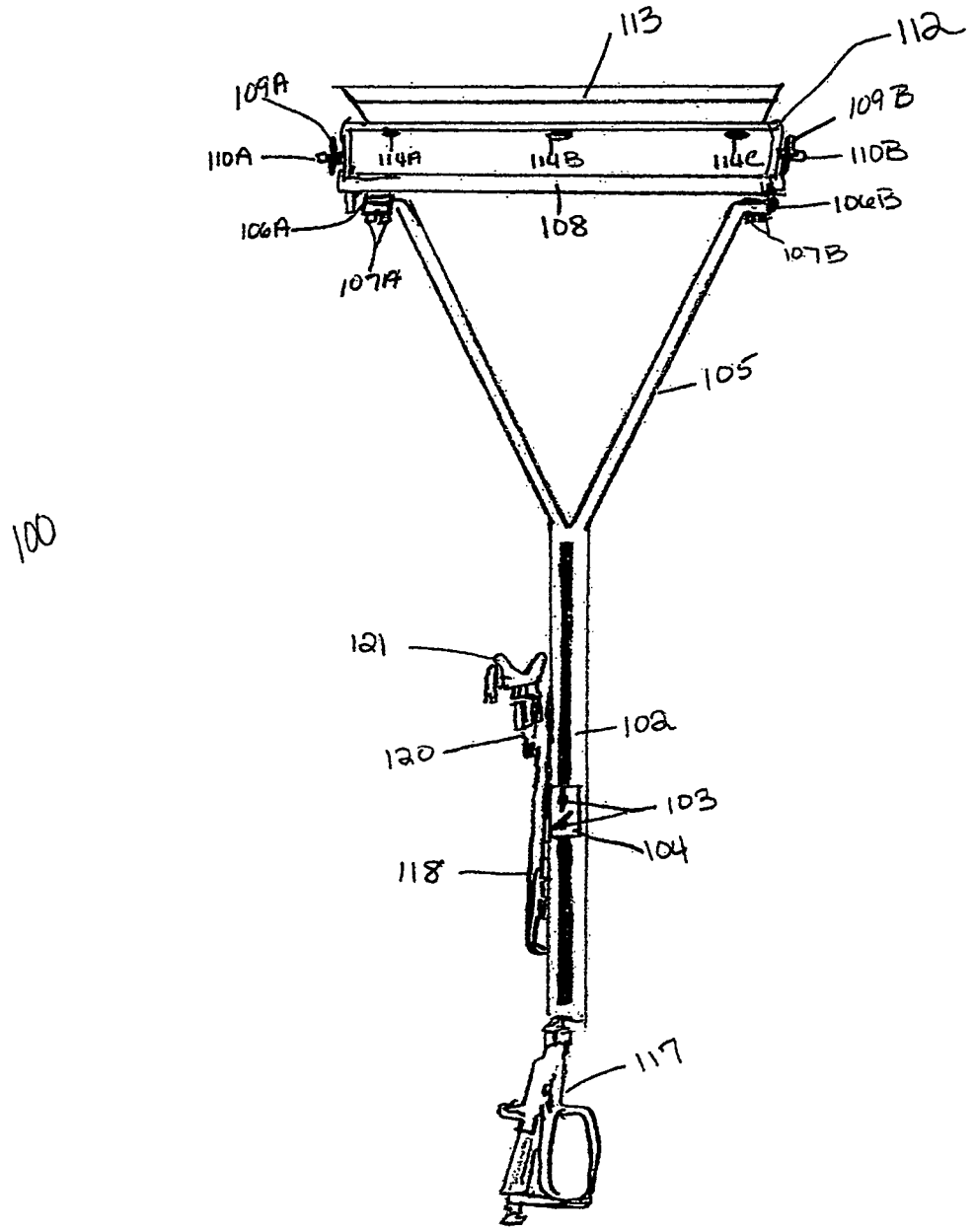

100 Finishing Tool
102 Handle
103 Wingnuts holding sliding plate in place on handle
104 Sliding Plate on handle to secure handle to Graco Extension Pole or equivalent
105 Frame that connects handle to the head of tool
106A Slot to adjust angle of pivoting head
106B Slot to adjust angle of pivoting head
107A Screw that tighten the pivoting head into slot
107B Screw that tightens the pivoting head into slot
108 Main Frame of head that controls wheel position
109A Wheels attached to main frame of head that will guide the spray fan.
109B Wheel attached to main frame of head that will guide the spray fan.
110A Bolt, 2 washers and locknut that attach the wheel to the main frame of head
110B Bolt, 2 washers and locknut that attach the wheel to the main frame of head
111A Bolt, washer and locknut that attach the Main Frame of Head to the Squeegee Frame
111B Bolt, washer and locknut that attach the Main Frame of Head to the Squeegee Frame
112 Squeegee Frame
113 Squeegee
114A Wing Nut that attaches the Squeegee to the Squeegee Frame
114B Wing Nut that attaches the Squeegee to the Squeegee Frame
114C Wing Nut that attaches the Squeegee to the Squeegee Frame

FIG. 2

100 Finishing Tool
102 Handle
106 Slot to adjust angle of pivoting head
107 Screw that tighten the pivoting head into slot
108 Main Frame of head that controls wheel position
109 Wheels attached to main frame of head that will guide the spray fan.
110 Bolt, 2 washers and locknut that attach the wheel to the main frame of head
111 Bolt, washer and locknut that attach the Main Frame of Head to the Squeegee Frame
112 Squeegee Frame
113 Squeegee
115 Tension Spring that provides tension between the Squeegee Frame and the Main Frame of the Head

FIG. 3

100 Finishing Tool
102 Handle
105 Frame that connects handle to the head of tool
106A Slot to adjust angle of pivoting head
106B Slot to adjust angle of pivoting head
107A Screw that tighten the pivoting head into slot
107B Screw that tightens the pivoting head into slot
108 Main Frame of head that controls wheel position
109A Wheels attached to main frame of head that will guide the spray fan.
109B Wheel attached to main frame of head that will guide the spray fan.

110A Bolt, 2 washers and locknut that attach the wheel to the main frame of head
110B Bolt, 2 washers and locknut that attach the wheel to the main frame of head
111A Bolt, washer and locknut that attach the Main Frame of Head to the Squeegee Frame
111B Bolt, washer and locknut that attach the Main Frame of Head to the Squeegee Frame
112 Squeegee Frame
113 Squeegee
114A Wing Nut that attaches the Squeegee to the Squeegee Frame
114B Wing Nut that attaches the Squeegee to the Squeegee Frame
114C Wing Nut that attaches the Squeegee to the Squeegee Frame

FIG. 4

100 Finishing Tool
105 Frame that connects handle to the head of tool
106A Slot to adjust angle of pivoting head
106B Slot to adjust angle of pivoting head
107A Screw that tighten the pivoting head into slot
107B Screw that tightens the pivoting head into slot
108 Main Frame of head that controls wheel position
109A Wheels attached to main frame of head that will guide the spray fan.
109B Wheel attached to main frame of head that will guide the spray fan.
110A Bolt, 2 washers and locknut that attach the wheel to the main frame of head
110B Bolt, 2 washers and locknut that attach the wheel to the main frame of head
112 Squeegee Frame
113 Squeegee
114A Wing Nut that attaches the Squeegee to the Squeegee Frame
114B Wing Nut that attaches the Squeegee to the Squeegee Frame
114C Wing Nut that attaches the Squeegee to the Squeegee Frame

FIG. 5

100 Finishing Tool
102 Handle
103 Wingnuts holding sliding plate in place on handle
104 Sliding Plate on handle to secure handle to Graco Extension Pole or equivalent
105 Frame that connects handle to the head of tool
106 Slot to adjust angle of pivoting head
107 Screw that tighten the pivoting head into slot
108 Main Frame of head that controls wheel position
109 Wheels attached to main frame of head that will guide the spray fan.
110 Bolt, 2 washers and locknut that attach the wheel to the main frame of head
111 Bolt, washer and locknut that attach the Main Frame of Head to the Squeegee Frame
112 Squeegee Frame
113 Squeegee
115 Tension Spring that provides tension between the Squeegee Frame and the Main Frame of the Head
116 Spacer and housing for sliding plate to attach Extension Pole (Graco used in example)
117 Airless Spray Gun (Graco used in example)
118 Quick Handle Attachment (Graco used in example)
119 Airless Extension Pole (Graco used in example)
120 Clean Shot Shutoff Valve (Graco used in example)
121 Spray tip and housing (Graco used in example)

FIG. 6

100 Finishing Tool
102 Handle
103 Wingnuts holding sliding plate in place on handle
104 Sliding Plate on handle to secure handle to Graco Extension Pole
105 Frame that connects handle to the head of tool
106 Slot to adjust angle of pivoting head
107 Screw that tighten the pivoting head into slot
108 Main Frame of head that controls wheel position
109 Wheels attached to main frame of head that will guide the spray fan.
110 Bolt, 2 washers and locknut that attach the wheel to the main frame of head
112 Squeegee Frame
113 Squeegee
114A Wing Nut that attaches the Squeegee to the Squeegee Frame
114B Wing Nut that attaches the Squeegee to the Squeegee Frame
114C Wing Nut that attaches the Squeegee to the Squeegee Frame
117 Airless Spray Gun (Graco used in example)
118 Quick Handle Attachment (Graco used in example)
120 Clean Shot Shutoff Valve (Graco used in example)
121 Spray tip and housing (Graco used in example).

What is claimed is:

1. A drywall finishing tool comprising:

a twin tube handle functioning as an extruded main body assembly;

an adjustable sliding saddle that travels fore and aft on the twin tube body;

a frame that connects the twin tube handle to a head of the drywall finishing tool, the head including a main frame attached to the frame and a squeegee frame attached to the main frame;

adjustable wheels disposed at a distal end of the main frame, the adjustable wheels guiding a spray fan released from a spray tip attached to an extension pole with a spray gun disposed on the twin tube body;

the squeegee frame, forming a portion of the head, attached to the main frame;

a squeegee/skimmer blade pivotably disposed on the squeegee frame;

a tension spring between the main frame and the squeegee frame; and an airless spray supply input hose connecting the spray gun with a source of material to be delivered out of the spray tip.

2. A drywall finishing tool comprising:

a handle having a longitudinal axis, wherein a proximate end of the longitudinal axis of the handle is formed from two tubular members disposed side-by-side, wherein the two tubular members separate in a central region of the handle to terminate in a spaced apart arrangement of two separate tubes at a distal end of the handle;

an adjustable sliding saddle that travels fore and aft on the handle on the proximate end thereof;

an extension pole attached to the sliding saddle;

a spray gun attached to one end of the extension pole;

a spray tip attached to the spray gun;

adjustable wheels guiding a spray fan of material released from the spray tip attached to the spray gun;

a main frame disposed at the distal end of the handle;

a squeegee frame disposed on the main frame;

a squeegee/skimmer blade disposed on the squeegee frame; and a tension spring between the main frame and the squeegee frame, wherein the tension springs allows the squeegee/skimmer blade to float along a surface to remove excess material released by the spray tip while the adjustable wheels keep the spray head at a precise distance from the surface.

3. The drywall finishing tool of claim 2, further comprising a spray supply input hose interconnecting the spray gun with the material.

4. The drywall finishing tool of claim 3, wherein the spray supply input hose is up to 50 feet in length.

5. The drywall finishing tool of claim 2, further comprising a twin tube handle attached to the extension pole with the spray gun and the spray tip, the extension pole permitting the drywall finishing tool to be used at a height of at least 8 feet.

6. The drywall finishing tool of claim 2, wherein the squeegee/skimmer blade has a width from about 6" to about 36".

7. The drywall finishing tool of claim 6, wherein the squeegee/skimmer blade is replaceable.

8. The drywall finishing tool of claim 2, wherein the material is joint compound.

9. A drywall finishing tool comprising:

a handle;

an adjustable sliding saddle that travels fore and aft on the handle;

a spray gun attached to an extension pole with the spray gun and a spray tip; the extension pole attached to the sliding saddle;

a spray tip attached to the spray gun;

a main frame disposed on the distal end of the handle;

adjustable wheels guiding a spray fan of material released from the spray tip, the adjustable wheels attached to the main frame;

a squeegee frame disposed on the main frame;

a squeegee/skimmer blade disposed on the squeegee frame;

a tension spring between the main frame and the squeegee frame, wherein as the adjustable wheels are moved along a surface, the squeegee/skimmer blade floats across the surface to remove excess material released by the spray tip; and a spray supply input hose interconnecting the spray gun with the material.

10. The drywall finishing tool of claim 9, wherein the extension handle permits the drywall finishing tool to be used at a height of at least 8 feet.

11. The drywall finishing tool of claim 9, wherein the squeegee/skimmer blade has a width from about 6" to about 36".

12. The drywall finishing tool of claim 11, wherein the squeegee/skimmer blade is replaceable.

13. The drywall finishing tool of claim 9, wherein the material is joint compound.

14. The drywall finishing tool of claim 9, wherein the handle has a longitudinal axis, wherein a proximate end of the longitudinal axis of the handle is formed from two tubular members disposed side-by-side, wherein the two tubular members separate in a central region of the handle to terminate in a spaced apart arrangement of two separate tubes at a distal end of the handle.

15. The drywall finishing tool of claim 14, wherein the adjustable sliding saddle moves along the two tubular members disposed side-by-side.

* * * * *